US009091035B2

(12) United States Patent
DeWind

(10) Patent No.: US 9,091,035 B2
(45) Date of Patent: Jul. 28, 2015

(54) SYSTEM AND METHOD OF FORMING AN UNDERGROUND SLURRY WALL

(75) Inventor: Gregory Allen DeWind, Zeeland, MI (US)

(73) Assignee: DeWind One-Pass Trenching, LLC, Zeeland, MI (US)

( * ) Notice: Subject to any disclaimer, the term of this patent is extended or adjusted under 35 U.S.C. 154(b) by 366 days.

(21) Appl. No.: 13/604,549

(22) Filed: Sep. 5, 2012

(65) Prior Publication Data

US 2014/0064860 A1 Mar. 6, 2014

(51) Int. Cl.

| | |
|---|---|
| ***E02D 3/00*** | (2006.01) |
| ***E02F 5/12*** | (2006.01) |
| ***E02F 5/02*** | (2006.01) |
| ***E02F 3/08*** | (2006.01) |

(52) U.S. Cl.
CPC . *E02D 3/00* (2013.01); *E02F 3/083* (2013.01); *E02F 5/02* (2013.01)

(58) Field of Classification Search
CPC ..... E02D 3/00; E02D 3/12; E02D 3/126; E02F 3/08; E02F 3/083; E02F 3/10; E02F 3/30; E02F 5/02; E02F 5/06; E02F 5/12
USPC ..... 405/302.4, 129.45, 129.6, 55, 266, 267
See application file for complete search history.

(56) References Cited

U.S. PATENT DOCUMENTS

| | | | | |
|---|---|---|---|---|
| 4,681,483 | A * | 7/1987 | Camilleri | 405/267 |
| 5,275,513 | A * | 1/1994 | Geary et al. | 405/266 |
| 5,765,966 | A * | 6/1998 | White et al. | 405/174 |
| 5,830,752 | A * | 11/1998 | Bruso | 435/283.1 |
| 5,931,605 | A * | 8/1999 | Toor et al. | 405/128.45 |
| 6,171,024 | B1 * | 1/2001 | Curtis et al. | 405/128.45 |
| 6,193,444 | B1 * | 2/2001 | Jonninen | 405/258.1 |
| 2003/0185633 | A1 * | 10/2003 | Vandycke | 405/266 |
| 2007/0014637 | A1 * | 1/2007 | Trevisani | 405/258.1 |
| 2011/0091291 | A1 * | 4/2011 | Maher et al. | 405/302.4 |

* cited by examiner

*Primary Examiner* — John Kreck
*Assistant Examiner* — Stacy Warren
(74) *Attorney, Agent, or Firm* — The Watson I.P. Group, PLC; Jovan N. Jovanovic; Vladan M. Vasiljevic

(57) ABSTRACT

A method of forming an underground slurry wall having the steps of: (a) providing a trencher having a trenching arm assembly with a cutting tooth track; (b) providing a dispensing tube proximate the cutting tooth track; (c) rotating the cutting tooth track; (d) extending the cutting tooth track below the outside surface, to, in turn, agitate the soil therebelow to a predetermined depth; (d) translating the trenching arm assembly across the outside surface so as to form an underground wall of agitated soil; (e) dispensing a clay-like material proximate the cutting tooth track; and (f) utilizing the cutting tooth track to mix the clay-like material into the soil while the cutting tooth track is rotating and translating, to, in turn, mix the clay-like material into the agitated soil. Systems are likewise disclosed.

7 Claims, 9 Drawing Sheets

FIGURE 9
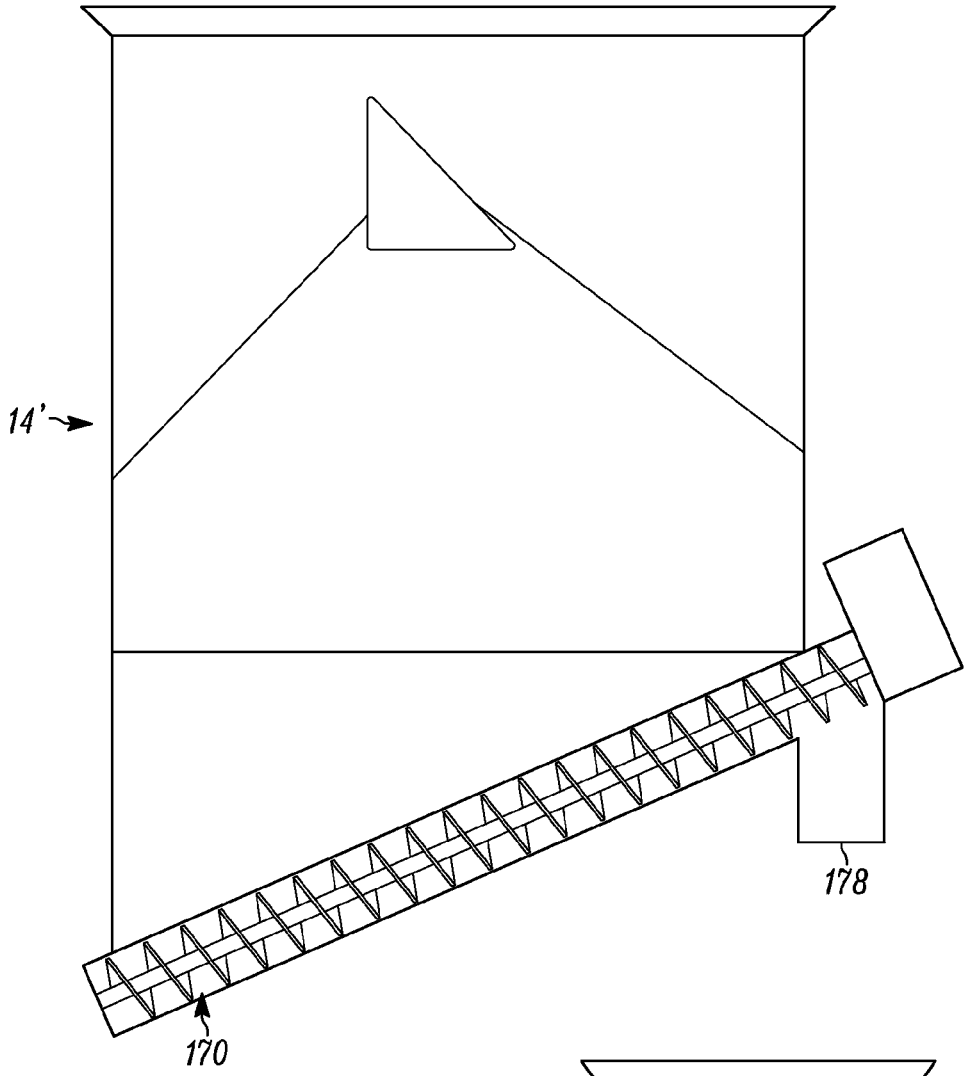
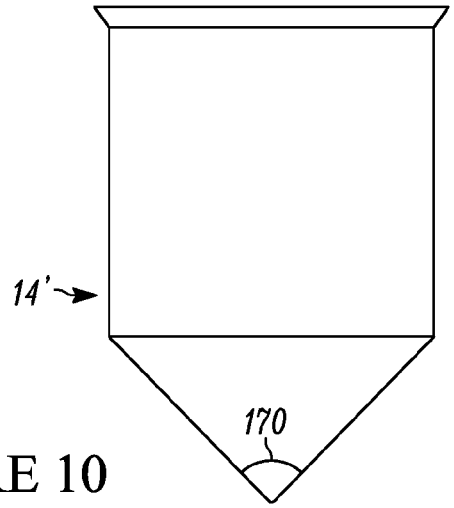
FIGURE 10

SYSTEM AND METHOD OF FORMING AN UNDERGROUND SLURRY WALL

BACKGROUND OF THE DISCLOSURE

1. Field of the Disclosure

The disclosure relates in general to trenching equipment and methods, and more particularly, to a system and method of forming an underground slurry wall which includes the mixing of outside material into an existing soil base through a trenching operation.

2. Background Art

The formation of underground slurry walls is well known in the art. An underground slurry wall is a non-structural wall that is a barrier to the movement of groundwater thereacross. Typically, the existing soil is mixed with an outside material (usually a clay-like material, such as bentonite) and then reintroduced into the trench. The addition of the outside material (hereinafter referred to as bentonite, although other materials are likewise contemplated) provides a barrier to the movement of horizontal groundwater. Additionally, for purposes of this material, clay-like material shall be defined as including bentonite, as well as other materials which may be natural or synthetic which are introduced into the soil during trenching so as to provide barrier properties to the soil. The disclosure is not limited to bentonite or to materials which include clay per se.

There are a number of manners in which to introduce the bentonite into the ground soil. For example, a deep trench may be dug, bentonite can be deposited into the deep trench, or mixed with the excavated soil, wherein the mixture is returned to the trench. It is understood that such a method may work for relatively shallow trenches, as it is difficult to dig deep trenches through such a method, and even for relatively shallow trenches, additional equipment, such as bracing and the like is required.

Other methods have a double trench approach. First a shallow trench is dug and bentonite is deposited into the shallow trench. Next, that trench may be backfilled so as to bury the bentonite. Once buried, a second trench is dug at the same location only deeper with trenching equipment that effectively mixes the bentonite through the entire depth with the existing soil. While such a trenching system is capable of use in deeper trenching environments, it is nevertheless less than optimal, as two separate trenches are required; first, a shallow trench to bury the bentonite, then a second deep trench on top of that trench to mix the bentonite to form the underground slurry wall. In many instances, such an approach results in extended time schedules, and often results in a very costly operation.

It is an object of the present invention to provide a relatively deep underground slurry wall, while mixing an outside material (such as bentonite) while forming the underground slurry wall in a single operation, while making a single pass across the landscape.

This objects as well as other objects of the present invention will become apparent in light of the present specification, claims, and drawings.

SUMMARY OF THE DISCLOSURE

The disclosure is directed to systems and methods for forming an underground slurry wall. Unlike prior art slurry walls that require multiple passes and multiple trenches, the present system is contemplated as forming the underground slurry wall in a single trenching operation.

More specifically, the method of forming an underground slurry wall comprises the steps of: (a) providing a trencher having a trenching arm assembly with a cutting tooth track; (b) providing a dispensing tube proximate the cutting tooth track; (c) rotating the cutting tooth track; (d) extending the cutting tooth track below the outside surface, to, in turn, agitate the soil therebelow to a predetermined depth; (d) translating the trenching arm assembly across the outside surface so as to form an underground wall of agitated soil; (e) dispensing a clay-like material proximate the cutting tooth track; and (f) utilizing the cutting tooth track to mix the clay-like material into the soil while the cutting tooth track is rotating and translating, to, in turn, mix the clay-like material into the agitated soil.

In a preferred embodiment, the clay-like material comprises bentonite.

In another preferred embodiment, the method further includes the steps of: (a) providing a storage container with the clay-like material remote of the trenching arm; and (b) feeding the clay-like material from the remote storage container to the dispensing tube at a predetermined rate.

In a preferred embodiment, the trencher further includes a cab spaced apart from the trenching arm, the storage container being coupled to the cab of the trencher.

Preferably, the step of feeding the clay-like material from the remote storage container further comprises the step of feeding the clay-like material through at least one flexible tube having a flexible auger positioned therein.

In another embodiment, the step of dispensing the clay-like material further comprises the steps of controlling the rate of flow of the clay-like material from within the dispensing tube.

In a preferred embodiment, the step of dispensing the clay-like material further comprises the step of providing an outside fluid to the clay-like material. Preferably, the outside fluid comprises water.

In another aspect of the disclosure, the disclosure is directed to a system for forming an underground slurry wall comprising a trencher, a material transport assembly, a material delivery assembly and a transport tube assembly. The trencher has a body, a boom pivotably coupled to and extending from the body and a trenching arm assembly pivotably coupled to and extending from the boom opposite the body. The material transport assembly has a distribution manifold spaced apart from the trenching arm. The material delivery assembly has a dispenser tube with a second end positioned adjacent the trenching arm, such that material dispensed from the second end can be mixed by the trenching arm during operation. The transport tube assembly extends from the distribution manifold to the dispenser tube. The transport tube assembly is configured to direct a clay-like material from the collection manifold to the dispenser tube during operation of the trenching arm, to, in turn, supply a clay-like material to the trenching arm during operation.

In a preferred embodiment, the material transport assembly further includes a collection manifold positioned adjacent to the trenching arm assembly. The collection manifold includes an inlet coupled to the tube transport assembly, and an outlet coupled to the dispensing tube.

In a preferred embodiment, the transport tube assembly further comprises at least one outer flexible tube that has an inner flexible auger extending therethrough, and a motor drive coupled to the flexible auger. The motor drive is configured to rotate the flexible auger within the outer flexible tube, to, in turn, direct the clay-like material from the distribution manifold to the collection manifold.

In another preferred embodiment, the at least one outer flexible tube comprises at least four outer flexible tubes, each of which includes an inner flexible auger extending therethrough, coupled to a motor drive.

In another preferred embodiment, the system includes a controller coupled to the motor drive. The controller is configured to control the speed of the motor drive, and in turn, the auger coupled thereto.

In another preferred embodiment, the dispensing tube further includes an auger extending therethrough, and a feed mixing tube positioned so as to be in fluid communication therewith. The transport tube assembly is coupled to the feed mixing tube, with the auger coupled to a motor.

In another preferred embodiment, a controller is coupled to the motor, to, in turn, control the speed of the motor and the speed of the auger.

In another aspect of the disclosure, the disclosure is directed to another system for forming an underground slurry wall comprising a trencher, a material transport assembly and a material delivery assembly. The trencher has a body, a boom pivotably coupled to and extending from the body and a trenching arm assembly pivotably coupled to and extending from the boom opposite the body. The material transport assembly is positioned proximate the trenching arm assembly. The material transport assembly has a cavity and an auger positioned proximate a lower end of the cavity. The material delivery assembly has a dispenser tube with a second end positioned adjacent the trenching arm, such that material dispensed from the second end can be mixed by the trenching arm during operation. Further, a feed mixing tube is in fluid communication with the dispenser tube spaced apart from the second end thereof. The auger of the material transport assembly is coupled to the feed mixing tube, to, in turn, direct a clay-like material from the cavity to the dispenser tube during operation of the trenching arm, to, in turn, supply a clay-like material to the trenching arm during operation.

BRIEF DESCRIPTION OF THE DRAWINGS

The disclosure will now be described with reference to the drawings wherein:

FIG. 9 of the drawings is a cross-sectional view of the alternate embodiment of the material transport assembly; and FIG. 10 of the drawings is a cross-sectional view of the alternate embodiment of the material transport assembly.

DETAILED DESCRIPTION OF THE DISCLOSURE

Figure 1:
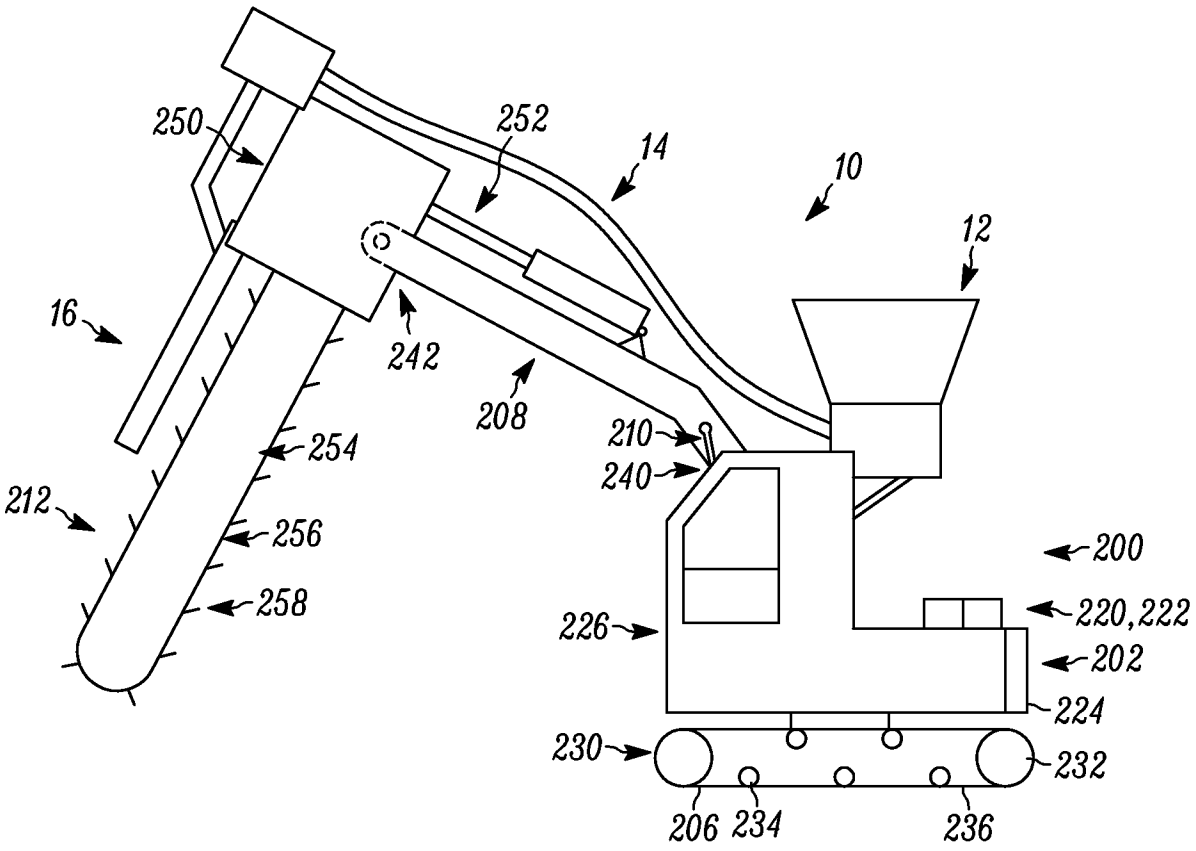
FIG. 1 of the drawings is a side elevational schematic view of a trencher having the trenching feed system of the present disclosure, showing, in particular, the trenching arm assembly of the present disclosure articulated above the outside surface.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the disclosure is directed to a trencher, such as trencher 200, and more specifically to a trench material feed system 10. Equipment such as trencher 200 is known in the art. Such trenchers can provide a trench of a specific desired depth in a single pass or in a single step. In various embodiments, a trench can be created that is of a desired width to a desired depth. Such trenchers will be described below in greater detail.

In many instances, it becomes necessary to mix in a separate component during the trenching process. For example, when making an underground barrier wall, it may become necessary to mix a clay like constituent into the mix to enhance the barrier properties of the natural soil. One such clay like constituent is bentonite, although other constituents are likewise contemplated for use. The remote material feed system 10 facilitates the inclusion and mixing of the prescribed amount of such a constituent during the formation of an underground barrier wall (often referred to as an underground slurry wall).

The trencher 200 utilized in association with the trenching remote material feed system 10 is shown in FIG. 1. Of course, the disclosure is not limited to any particular configuration and/or brand or model of trencher. In many instances, the trencher 200 comprises customized equipment that can be constructed from a conventional excavator. In other embodiments, a specialized trencher can be employed.

Figure 2:
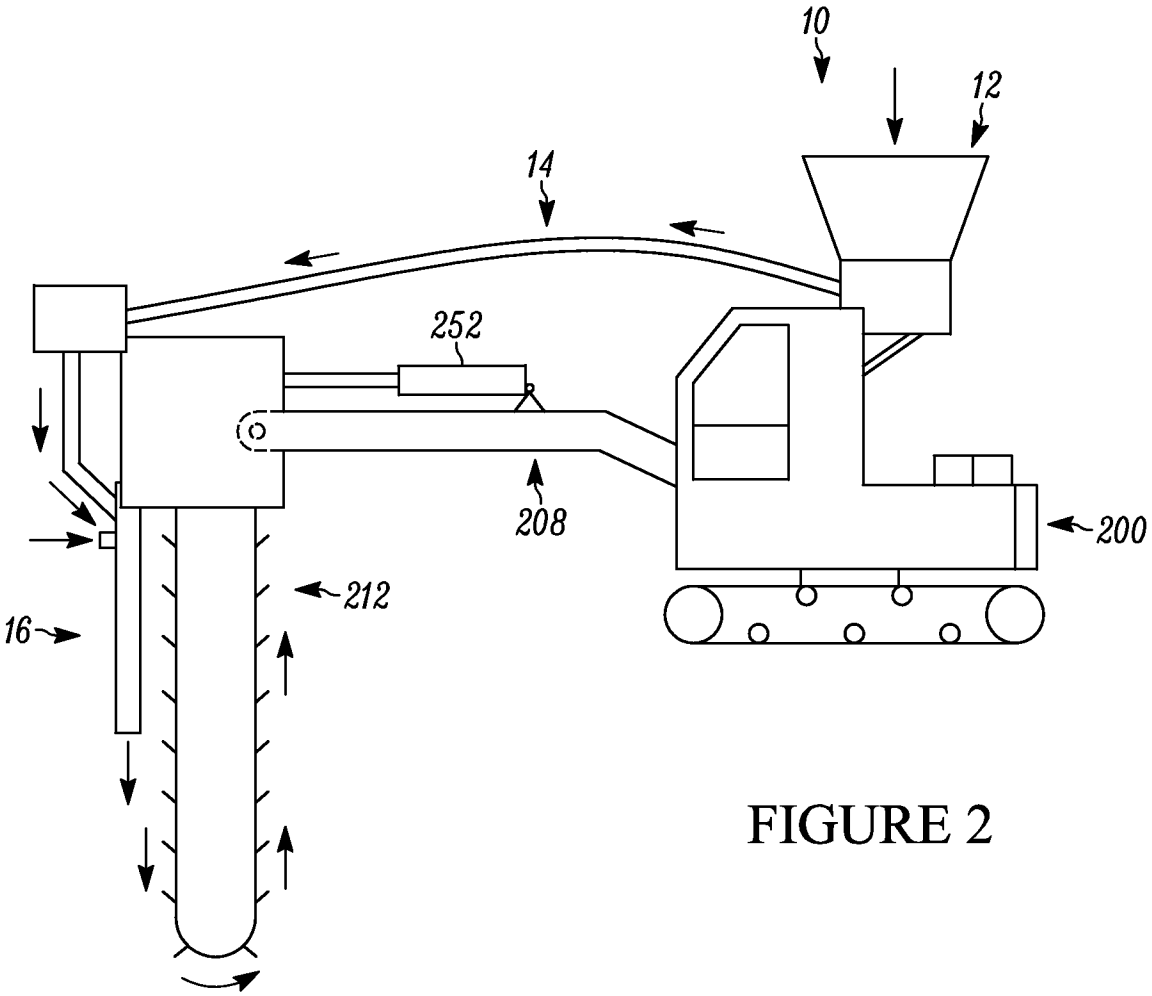
FIG. 2 of the drawings is a side elevational schematic view of a trencher having the trenching feed system of the present disclosure, showing, in particular, the trenching arm assembly of the present disclosure in an operating environment extending into the outer surface.

The exemplary trencher 200 is shown in FIGS. 1 and 2 as comprising body 202, track frame 204, track 206, boom 208, boom cylinder 210 and trenching arm assembly 212. The body 202 includes engine 220, hydraulic pump 222, counterweight 224 and cab 226. Essentially, the body includes the power and control system for the trencher 200.

The track frame is pivotally coupled to the body 202 and includes drive sprocket 230, idler 232 and rollers 234. Track 206 includes a plurality of shoes 236 which are rotatably coupled to each other. The track 206 spins around the drive sprocket 230, idler 232 and rollers 234 so as to translate the trencher 200 across the ground or other surface.

The boom 208 includes first end 240 and second end 242. The first end 240 is pivotally coupled to the body 202 and the second end 242 extends therefrom. The boom typically includes a boom cylinder 210 which facilitates the pivoting movement of the boom relative to the body 202.

The trenching arm assembly 212 is shown in FIG. 1 as comprising mounting housing 250, arm cylinder 252, arm 254 and cutting tooth track 256. The mounting housing 250 may include hydraulic motors, or may draw hydraulic power from the engine 220 which is contained on the body 202. The arm cylinder 252 facilitates the pivoting of the arm 254 relative to the boom 208. The cutting tooth track 256 extends about arm 254 and includes a plurality of teeth 258 which are configured to dig into the ground. It will be understood that any number of differently configured trenchers are contemplated for use, and that the trencher 200 is merely exemplary.

As explained above, such a trencher 200 can be utilized in the present disclosure to form an underground slurry wall of a desired depth (limited only by the size of the trencher, the power thereof, and the length of the trenching arm assembly). It will be understood that bentonite (or other outside clay like material) can be mixed into the existing soil base in a single pass of the trenching equipment, thereby minimizing the time, expenditure and equipment required to form the underground slurry wall. It is contemplated that such underground slurry walls may be in excess of fifty feet deep, and may be closer to 100 feet deep or more, limited only by the trenching equipment, and the limitations thereof.

Trenching remote material feed system 10 is shown in FIG. 1 as comprising material inlet hopper 12, material transport assembly 14, and material delivery assembly 16. The material inlet hopper 12 is positioned on or proximate the body 202 of the trencher 200. The material delivery assembly 16 is positioned at the second end 242 of boom 208. The material transport assembly 14 extends between the material inlet hopper 12 and the material delivery assembly 16 and accounts for the movement of the material inlet hopper 12 relative to the material delivery assembly 16, while, nevertheless delivering the necessary material between the material inlet hopper 12 and the material delivery assembly 16. The material delivery assembly is positioned adjacent the trenching arm assembly.

Figure 3:
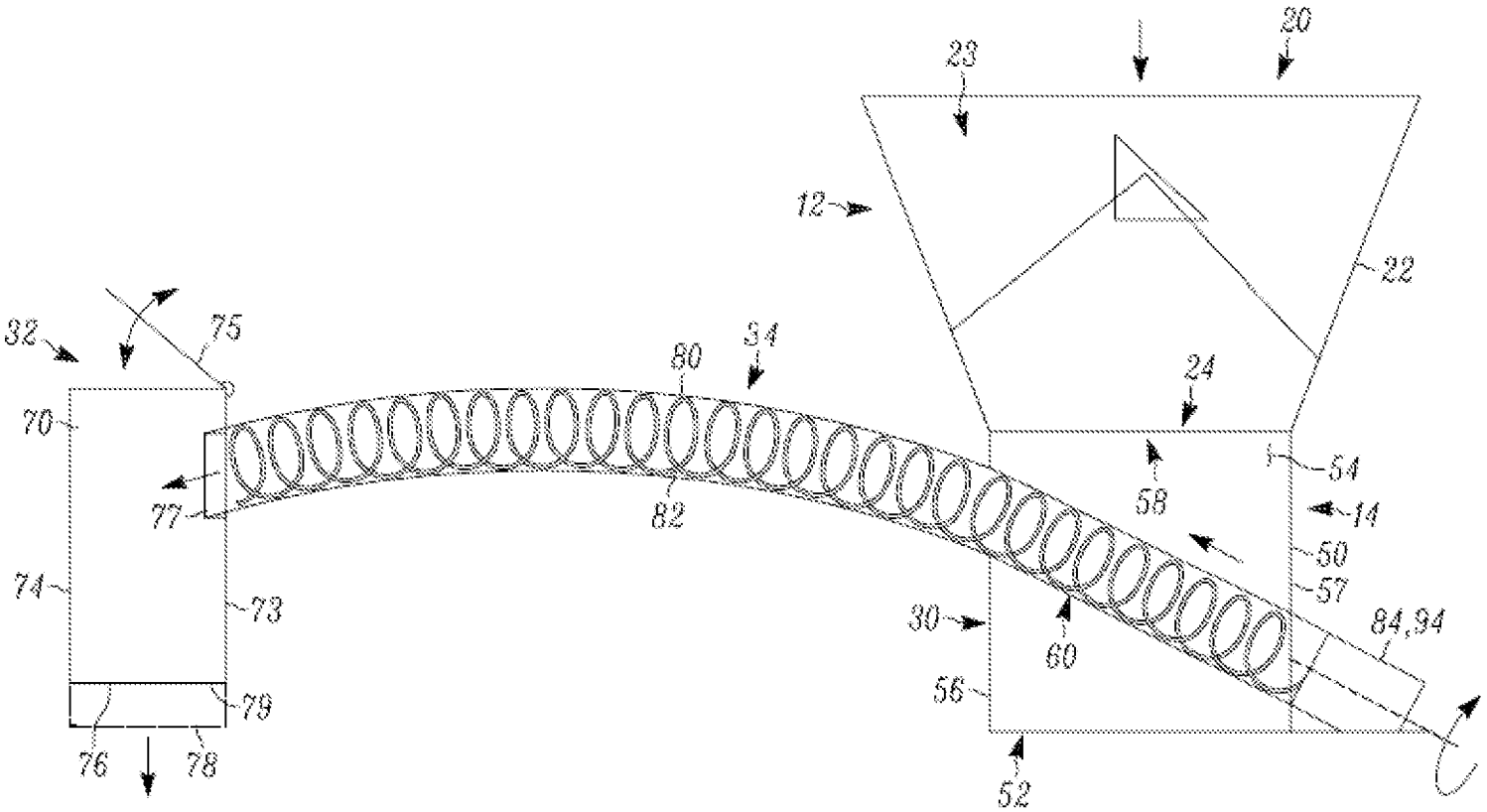
FIG. 3 of the drawings is a side cross-sectional schematic view of the trenching feed system of the present disclosure, showing, in particular, the movement of material from the material inlet hopper to the collection manifold of the material transport assembly.

The material inlet hopper 12 is shown in FIG. 3 as comprising inlet 20, walls 22 and outlet 24. These structures define cavity 23. The material inlet hopper, as shown, is configured so that the walls define a generally funnel like configuration wherein the inlet 20 is larger than the outlet, both of which are generally rectangular in shape. In one exemplary embodiment, the outlet has a rectangular configuration which is approximately 24 inches by 18 inches. Of course, other configurations are likewise contemplated, depending on the amount of material that is to be transmitted per unit time through the system 10.

Figure 4:
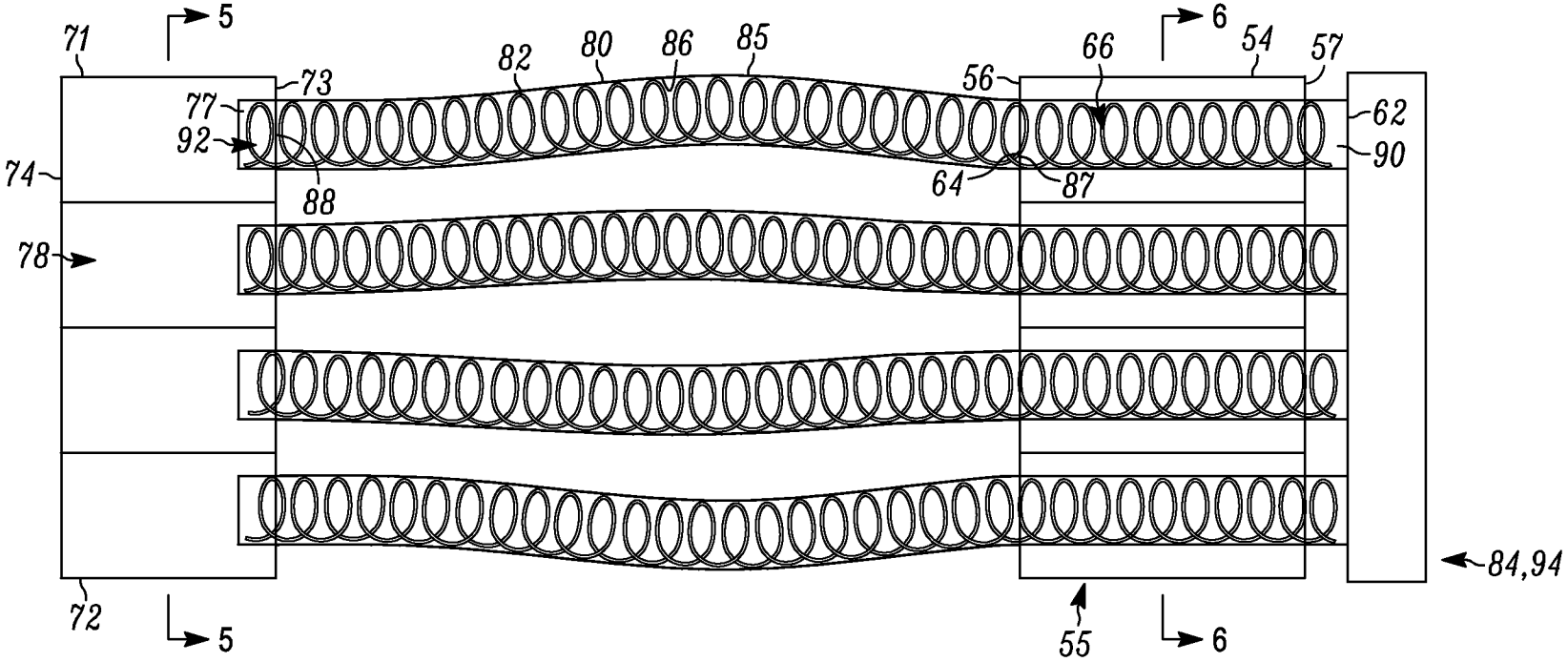
FIG. 4 of the drawings is a top cross-sectional schematic view of the trenching feed system of the present disclosure, showing, in particular, the movement of material from the material inlet hopper to the collection manifold of the material transport assembly.
Figure 6:
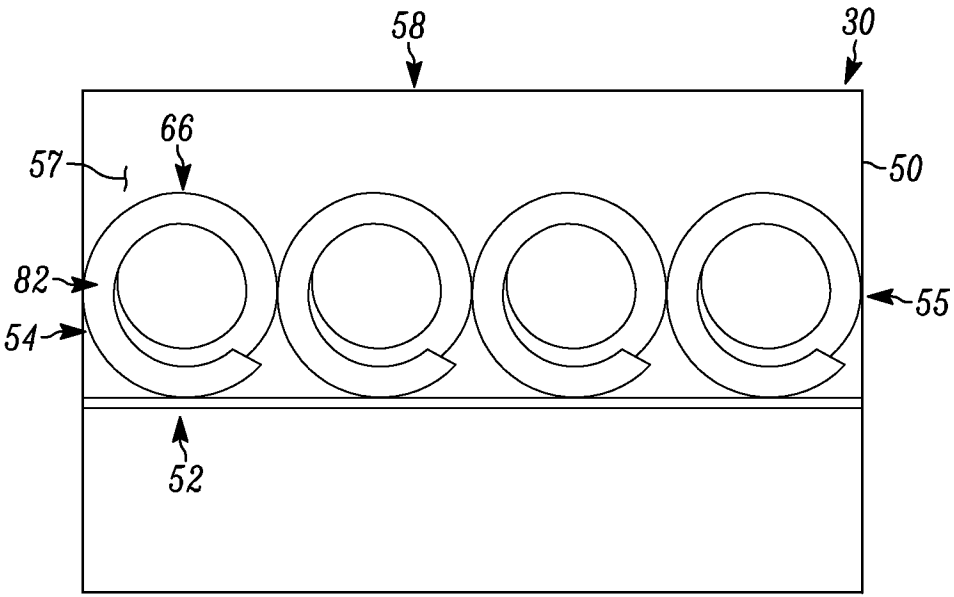
FIG. 6 of the drawings is a cross-sectional schematic view of the distribution manifold of the present disclosure, taken generally about lines 6-6 of FIG. 4.

The material transport assembly 14 is shown in FIGS. 3, 4 and 6 as comprising distribution manifold 30, collection manifold 32 and transport tube assembly 34. The distribution manifold 30 is coupled to the material inlet hopper 12 at or near body 202 of the trencher 200. The collection manifold 32 is coupled to the material delivery assembly 16 positioned at or near the mounting housing 250 of the trenching arm assembly 212. The transport tube assembly 34 extends between the two manifolds.

The distribution manifold includes housing 50 and elongated cylinders 60 that extend through the housing 50. The housing includes base 52, first end wall 54, second end wall 55, front wall 56, back wall 57 and upper opening 58. The base 52 in the embodiment shown comprises a rectangular configuration, although other embodiments are likewise contemplated. The first end wall 54 and the second end wall 55 are spaced apart from each other and extend substantially perpendicular to the base 52. The front wall 56 and the back wall 57 are spaced apart from each other and span between the end walls. The upper ends of the end walls, the front wall and the back wall together define the upper opening 58. Generally, the housing 50 comprises a rectangular cubic configuration.

The outlet 24 substantially matches upper opening 58 of the distribution manifold 30 so that the material inlet hopper can be positioned above the upper opening 58. In turn, material from the material inlet hopper can flow to the distribution manifold.

In the embodiment shown, four elongated cylinders, such as cylinder 60, extend through each of the front wall 56 and the back wall 57, at an angular displacement. As is shown, the four elongated cylinders 60 extend upwardly from the back wall 57 to the front wall 56. In the embodiment shown, the elongated cylinders are disposed at an angle of between 10° and 60° and more preferably to between 30° and 45°. The elongated cylinders are substantially linear. The four elongated cylinders are spaced apart and substantially parallel to each other.

The four elongated cylinders 60 are substantially identical, so a single elongated cylinder is disclosed in detail with the understanding that the remainder are substantially identical. The elongated cylinder 60 includes first end opening 62 and second end opening 64. The cylinder 60 is of a substantially uniform diameter. Between the front wall 56 and the back wall 57, a portion of the cylinder is removed so as to define upper inlet opening 66. The upper inlet opening 66 is in fluid communication with the first end opening 62 and the second end opening 64.

In the embodiment shown, the elongated cylinders are welded to the housing 50 so that they are fixed together. It will be understood that the elongated cylinders are coupled together in other manners so that they do not move relative to each other.

Figure 5:
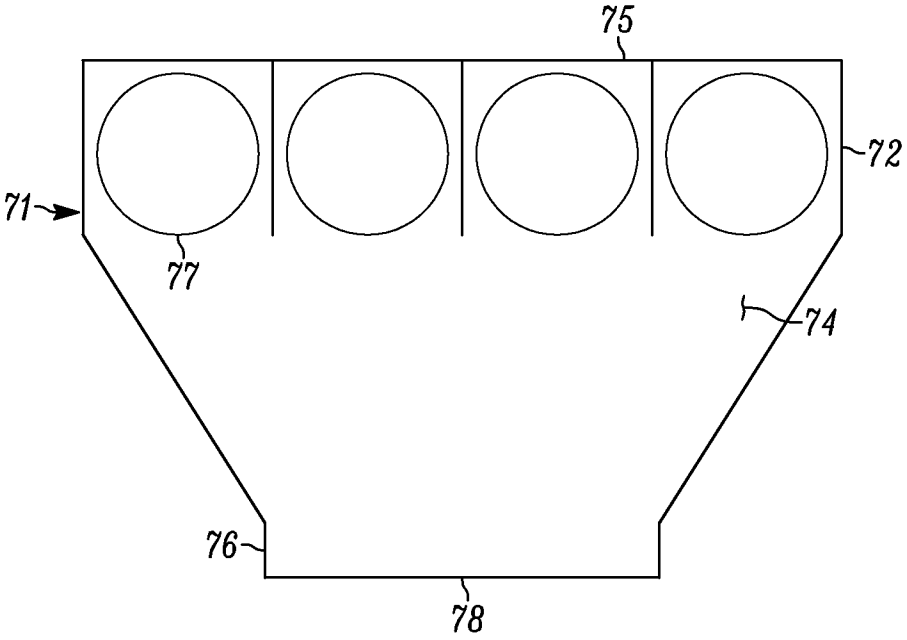
FIG. 5 of the drawings is a cross-sectional schematic view of the collection manifold of the present disclosure, taken generally about lines 5-5 of FIG. 4.

The collection manifold 32 is shown in FIGS. 3, 4, and 5 as comprising housing 70, that includes base 79, first end wall 71, second end wall 72, front wall 73, back wall 74, top wall 75, bottom wall 76, inlet openings 77 and outlet opening 78. The configuration of the housing 70 comprises a rectangular cubic configuration, generally. The inlet openings 77 substantially correspond in diameter and cross-sectional area to the elongated cylinders 60 of the distribution manifold 32, and extends through the front wall 73 generally perpendicularly to the front wall 73. An outlet is positioned at the base 79 of the manifold. The top wall 75 can be hinged to the front or back wall so as to preclude the undesirable ingress or egress of material from within the collection manifold.

Of course, the configuration of the collection manifold can be varied within the scope of the present disclosure. In particular, the collection manifold can have a different configuration and can be positioned in varying orientations at or near the mounting housing 250 of the trenching arm assembly 212.

The transport tube assembly 34 is shown in FIGS. 3 and 4, comprises a plurality of members that extend between one of the four elongated cylinders 60 and a corresponding one of the inlet openings 77 on the collection manifold 32. As each of the members is substantially identical, a single transport tube will be described with the understanding that the remaining members have similar features.

The transport tube includes outer flexible tube 80, inner flexible auger 82 and motor drive 84. The outer flexible tube 80 includes outer surface 85, inner surface 86, distribution end 87, and collection end 88. The outer flexible tube generally comprises a polymer based tubular member that can flex to the extent necessary. PVC, ABS plastic, or the like are contemplated for use, and the invention is not limited to any particular tubing material. The outer flexible tube 80 generally comprises a single monolithic element, however, it is also contemplated that the outer flexible tube 80 may comprise a plurality of components that are coupled together end to end, or the like.

In the embodiment shown, the outer flexible tube is on the order of fifty feet long, and of monolithic construction. The outer flexible tube can flex several feet in any direction between the distribution end 87 and the collection end 88. The distribution end 87 is coupled to the first end opening 62 of the elongated cylinder 60 of the distribution manifold 30. The collection end is sealingly coupled to the inlet opening 77 of the housing of the collection manifold 32. For example, a clamp may be utilized at either end of the outer flexible tube to sealingly couple the outer flexible tube to the collection manifold and the distribution manifold. In other embodiments, fittings may be coupled to either end of the outer flexible tube which matingly engage other fittings on the manifolds. Of course, other devices are likewise contemplated, such as seals and the like.

The inner flexible auger 82 includes first end 90 and second end 92. The inner flexible auger 82 extends from the first end opening 62 of the elongated cylinder 60, to the inlet opening 77. That is, the first end 90 of the inner flexible auger 82 is positioned at or near the first opening 62 of the elongated cylinder 60. The second end 92 extends to the inlet opening 77.

The motor drive 84 is coupled to the first end 90 of the inner flexible auger, and is fixedly coupled to the distribution manifold, and in particular at the first end opening 62. The motor drive 84 is controlled from the controller 94 which can be located within cab 226 of the body 202. The motor drive 84 may comprise a separate or distinct motor unit, or, may be hydraulic, which can be coupled to the engine 220 of the trencher 200. When actuated, the motor drive 84 rotates the inner flexible auger 82 in the desired direction of rotation. The controller controls the rotative speed of the motor drive, to, in turn, control the speed at which the auger rotates.

Figure 7:
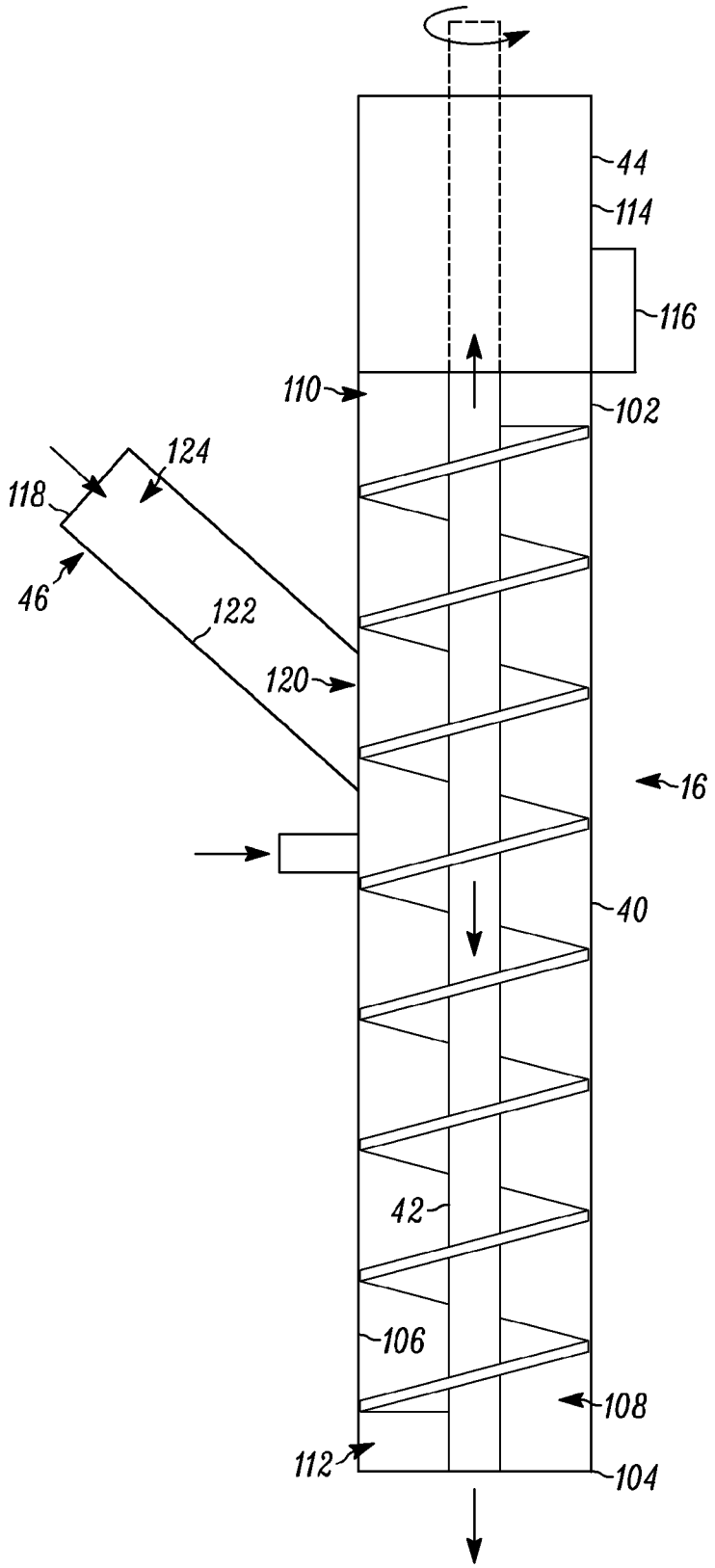
FIG. 7 of the drawings is a side cross-sectional schematic view of the material delivery assembly of the present disclosure.

The material delivery assembly 16, shown in FIG. 7, comprises dispensing tube 40, auger 42, motor assembly 44 and feed mixing tube 46. The dispensing tube 40 includes first end 102, second end 104, inner surface 106 and passageway 108. The passageway 108 extends from the first end 102 to the second end 104. In the embodiment shown, the passageway 108 is substantially uniform between the first and second ends.

The auger 42 includes first end 110 and second end 112. The first end 110 corresponds to the first end 102 of the dispensing tube 40. The second end 112 corresponds to the second end 104 of the dispensing tube 40. The second end of the dispensing tube is positioned adjacent to the trenching arm so that material exiting therefrom can be quickly mixed by the trenching arm during operation. It will be understood that the second end position relative to the trenching arm can be varied to achieve the desired mixing of the constituents. The first end 110 of the auger 42 is coupled to motor assembly 44, which includes motor 114 and controller 116. The motor 114 comprises, for example, a hydraulic motor, which may be powered locally, or from the engine 220 of the body 202 of the trencher 200. The controller 116 is coupled to the cab 226, so that the controller can be instructed from within the cab, to control, for example, the speed of the motor 114, and, in turn, the speed of the auger to which the motor is coupled.

The feed mixing tube 46 is shown in FIG. 7 as comprising first end 118, second end 120, inner surface 122 and passageway 124. The first end 118 of the feed mixing tube 46 is coupled to the outlet opening 78 of the collection manifold 32. The second end 120 is coupled to the dispensing tube between the first and second ends, so as to direct material toward and into the auger 42. The feed mixing tube 46 may also include an inlet for water or another fluid, such that the material from within the collection manifold can be mixed with water (or another fluid) just prior to, or just as the material is entering into the auger 42 so as to form a slurry that is introduced to the trenching arm for mixing.

The second end of the dispensing tube is 104 is directed into the trench proximate the arm 254, so that the material exiting from within the material delivery assembly is mixed with the trenching soil to result in a substantially uniform distribution through the trench.

In operation, such equipment is well suited to providing a particular fill material into a trench for mixing with existing soil so as to form an underground slurry wall (sometimes referred to as a barrier wall). For example, it is often necessary to mix a clay-like material, such as bentonite or the like, into existing soil (also referred to as native soils) to alter the properties of that soil in a desirable manner. The percentage of bentonite that is required is based on the properties of the native soils, as well as the existing surrounding conditions. It is not uncommon to have a bentonite percentage of between 1% and 5%. The particular requirements of a project are typically determined through analysis and calculations which are commonly known to those of skill in the art.

In the past, it has been known to add bentonite into native soil at a trenching site to enhance the barrier properties of the soil to form a slurry wall. Typically, this is achieved by digging a small trench of relative shallow depth, and then inserting the desired amount of bentonite, and, optionally, refilling with soil. A trencher is then brought over the same trench, at, typically, a significantly greater trenching depth to mix the soil in the trench with the inserted bentonite. Problematically, this tends to require a multitude of steps, namely the digging of a first shallow trench, refilling of the trench, and then a second trenching operation so as to mix the soil with the inserted material (bentonite).

Advantageously, with the present system, a user can make a single trenching operation to the required depth and mix the material (bentonite) in a single operation. Moreover, in the preferred embodiment, the bentonite, or other material that is contemplated (as disclosed above), can be supplied remote of the trench. This is often very useful where there is very little stable ground on either side of the trench. Where there is plenty of stable ground, the bentonite can be supplied to the collection manifold directly by way of a loader, excavator, truck, conveyor or the like.

The embodiment that will be described in detail comprises one wherein the bentonite is supplied to the distribution manifold located at or near the body of the trencher (i.e., the embodiment shown in FIGS. 1 through 7). It will be understood that the disclosure is not limited to such a structure, and that, indeed, a number of different manners of delivery are contemplated.

As an initial matter, it will be understood that the distribution manifold is located remotely from the trenching arm assembly, such as, for example, on top of the body 202 of the trencher 200, or in close proximity thereto. The collection manifold is positioned proximate the mounting housing 250 of the trenching arm assembly 212. The transport tube assembly 34 extends therebetween. In the embodiment shown, there are a total of four outer flexible tubes which extend between the distribution manifold and the collection manifold. In the embodiment shown, it is contemplated that each of the flexible tubes may be between twenty and one hundred feet long, although, it is contemplated that they may be longer or shorter as well.

In such an embodiment, bentonite is typically provided in a bulk bag, a large sack, or in another storage container. The bentonite is then removed from the bulk bag and placed into the collection manifold. It will be understood, that in certain embodiments, the collection manifold may include a bulk bag piercing structure so that a full bulk bag can be dropped into the collection manifold onto the piercing structure, and then, the piercing structure can puncture the bulk bag allowing the bentonite to be released into the housing.

Once the bentonite is within the housing of the collection manifold, the transport tube assembly is activated. That is, the motor drive 84 is activated directing the inner flexible augers to rotate at a speed prescribed by the controller 94. As the inner flexible augers rotate, the bentonite is first directed into the upper inlet opening 66 of the elongated cylinders in the distribution manifold. Continuous rotation of the inner flexible auger then pushes and draws the material into the outer flexible tube 80. Thus, taken from the distribution manifold and directed to the collection manifold. The rate of material delivery from the distribution manifold to the collection manifold can be metered by adjusting the speed of the motor drive so as to control the rotational speed of the inner flexible auger. An increase in speed, will correspondingly increase the quantity of material delivered to the collection manifold.

As the bentonite reaches the collection manifold, it collects therewithin and is directed to the outlet opening 78. From within the outlet opening 78, bentonite is directed to the first end of the feed mixing tube 46. At this point, the bentonite can be mixed with water to achieve a certain desired consistency of the material.

As the bentonite reaches the second end of the feed mixing tube, the bentonite is directed into the dispensing tube and then driven toward the second end thereof by the auger 42 positioned within the dispensing tube. It will be understood that the ultimate feed rate of the bentonite through the dispensing tube is controlled by the speed of the auger 42. It will also be understood that the speed of the auger can be coupled to the speed of the trencher along the trench, as well as the speed of the cutting tooth track 256 of the trencher, so as to insure that the proper amount of bentonite is delivered to the trench to achieve the proper mix of materials.

It will be understood that a controller may control the speed of the auger relative to the other parameters, such as cutting tooth track speed, trenching speed, water supply pressure, trench soil constituents and variations, among other parameters. The user can also manually adjust and alter the speed of the auger, and in turn, the rate at which the bentonite is supplied into the soil.

While the distribution manifold is shown as being coupled to the body of the trencher, it will be understood that the distribution manifold can be positioned on, for example, a skid or a pallet, which is positioned on the ground or on other equipment, such as a truck or the like. It will also be understood that the collection manifold may be associated with the boom or the trenching arm assembly, or, alternatively, may be coupled to another structure proximate the location of the trenching arm assembly.

Figure 8:
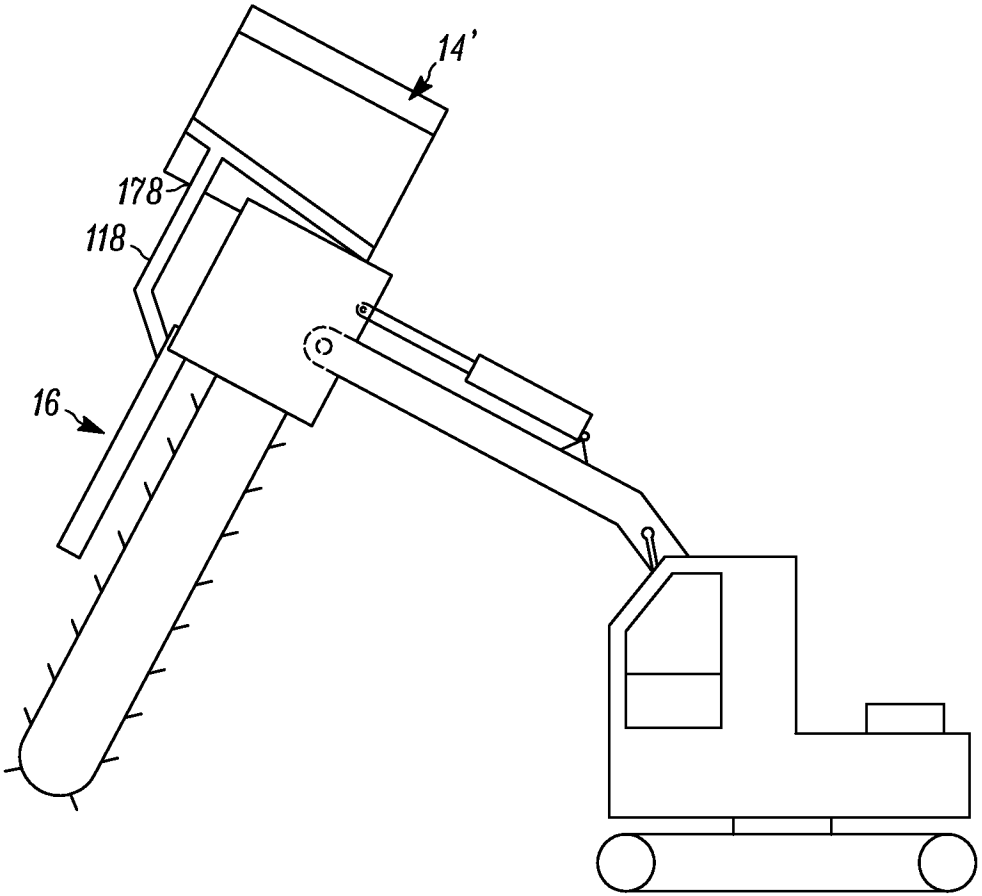
FIG. 8 of the drawings is a side elevational schematic view of a trencher having the trenching feed system of the present disclosure, showing, in particular, the trenching arm assembly of the present disclosure articulated above the outside surface with an alternate embodiment of the material transport assembly.

It will be understood that in other embodiments, wherein a remote delivery is not required or desired, an alternate delivery system is contemplated for use. Such an embodiment is shown in FIGS. 8 through 10, as comprising a single material transport assembly 14'. With reference to FIGS. 9 and 10, The single material transport assembly 14' includes a body having an angled shape so as to define a cavity with an auger 170 positioned at the bottom thereof. Such a single material transport assembly 14' can be coupled to either one or both of the boom or the trenching arm assembly, or, in other embodiments, positioned proximate thereto, such that gravity feed of the bentonite is facilitated proximate to the material delivery assembly.

The bentonite is dropped into the body (and, in the embodiment shown, the bentonite can be dropped into the body with the entirety of the bulk bag, wherein the bulk bag is pierced). The bentonite then is through gravity directed to the auger and the auger directs the same to the outlet opening 178.

The outlet opening 178 is coupled to the first end 118 of the feed mixing tube. Once the bentonite reaches the first end 118, the operation is substantially identical to that of the embodiment described above.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A system for forming an underground slurry wall comprising:

a trencher having a body, a boom pivotably coupled to and extending from the body and a trenching arm assembly pivotably coupled to and extending from the boom opposite the body;

a material inlet hopper, with a material transport assembly positioned proximate an outlet thereof, the material transport assembly having a distribution manifold spaced apart from the trenching arm assembly, the material transport assembly having at least one elongated cylinder extending therethrough, the at least one elongated cylinder having a first open end and a second open end, each isolated from the material inlet hopper, with a portion of the at least one elongated cylinder removed between the first and second open ends so as to define an upper inlet opening thereinto, with the upper inlet opening in communication with the material inlet hopper, the material transport assembly further including a collection manifold positioned adjacent to the trenching arm assembly, the collection manifold including an inlet and an outlet;

a material delivery assembly having a dispenser tube with a second end positioned adjacent the trenching arm assembly, such that material dispensed from the second end is capable of being mixed by the trenching arm assembly during operation, with the outlet of the collection manifold coupled to the dispenser tube;

the material transport assembly further including a transport tube assembly extending from the first open end of the at least one elongated cylinder to the inlet of the collection manifold, the transport tube assembly configured to direct a clay-like material from the distirbution manifold to the collection manifold during operation of the trenching arm assembly, to, in turn, supply a clay-like material to the trenching arm assembly during operation; and the transport tube assembly including at least one outer flexible tube, with an inner flexible auger extending therethrough, with the inner flexible auger extending out of the at least one outer flexible tube, and into the first open end of the at least one elongated cylinder to the second open end thereof, and a motor drive coupled to the inner flexible auger proximate the second open end of the at least one elongated cylinder configured to rotate the inner flexible auger within the at least one outer flexible tube, to, in turn, direct the clay-like material from the distribution manifold to the collection manifold, wherein the inner flexible auger extends out of the at least one outer flexible tube and through the at least one elongated cylinder.

2. The system of claim 1 wherein the at least one outer flexible tube comprises at least four outer flexible tubes, and the at least one elongated cylinder comprises at least four elongated cylinders each of which includes an inner flexible auger extending therethrough, coupled to the motor drive.

3. The system of claim 2 further comprising a controller coupled to the motor drive, the controller configured to control the speed of the motor drive, and in turn, the inner flexible auger coupled thereto.

4. The system of claim 2 wherein the dispenser tube further includes an auger extending therethrough, and a feed mixing tube positioned so as to be in fluid communication therewith, the transport tube assembly being coupled to the feed mixing tube, with the auger coupled to a motor.

5. The system of claim 4 further comprising a controller coupled to the motor, to, in turn, control the speed of the motor and the speed of the auger.

6. The system of claim 4 wherein the dispenser tube includes a separate inlet supplying water to the auger extending therethrough.

7. The system of claim 1 wherein the at least one elongated cylinder is inclined within the material transport assembly with the first open end positioned higher than the second open end.

* * * * *